United States Patent [19]

Plumlee et al.

[11] 4,049,537

[45] Sept. 20, 1977

[54] COAL LIQUEFACTION PROCESS

[75] Inventors: Karl W. Plumlee; Lonnie W. Vernon, both of Baytown, Tex.

[73] Assignee: Exxon Research & Engineering Co., Linden, N.J.

[21] Appl. No.: 686,814

[22] Filed: May 17, 1976

[51] Int. Cl.[2] ..... C10G 1/06

[52] U.S. Cl. ..... 208/10; 208/8

[58] Field of Search ..... 208/8, 10

[56] References Cited

U.S. PATENT DOCUMENTS 3,700,583 10/1972 Salamony et al. ..... 208/8

*Primary Examiner*—Delbert E. Gantz
*Assistant Examiner*—James W. Hellwege
*Attorney, Agent, or Firm*—Llewellyn A. Proctor

[57] ABSTRACT

A process for liquefying a particulate coal feed to produce useful petroleum-like liquid products by steps which include: (a) admixing said coal feed, a solvent, particularly a non-donor solvent, and a quinone compound, or admixture of quinone compounds, to form a coal liquid slurry, and then (b) contacting said coal liquid slurry with molecular hydrogen in a liquefaction zone at temperature and pressure sufficient to hydroconvert and liquefy the coal. In accordance with a preferred embodiment, the product from the liquefaction zone is separated by distillation into fractions inclusive of fractions boiling within about the 350°-850° F. range, and preferably within about the 400°-700° F. range, which can be recycled to the coal liquefaction zone for use in slurrying the coal. A feature of this invention is that the quinone compound acts as a hydrogenation catalyst, causing adequate hydrogenation of the coal within the coal liquefaction zone in the presence of the molecular hydrogen without any necessity of employing a hydrogen donor solvent, and hence there is no need for hydrogenation of the solvent in a separate hydrogenation zone.

14 Claims, 1 Drawing Figure

FIGURE
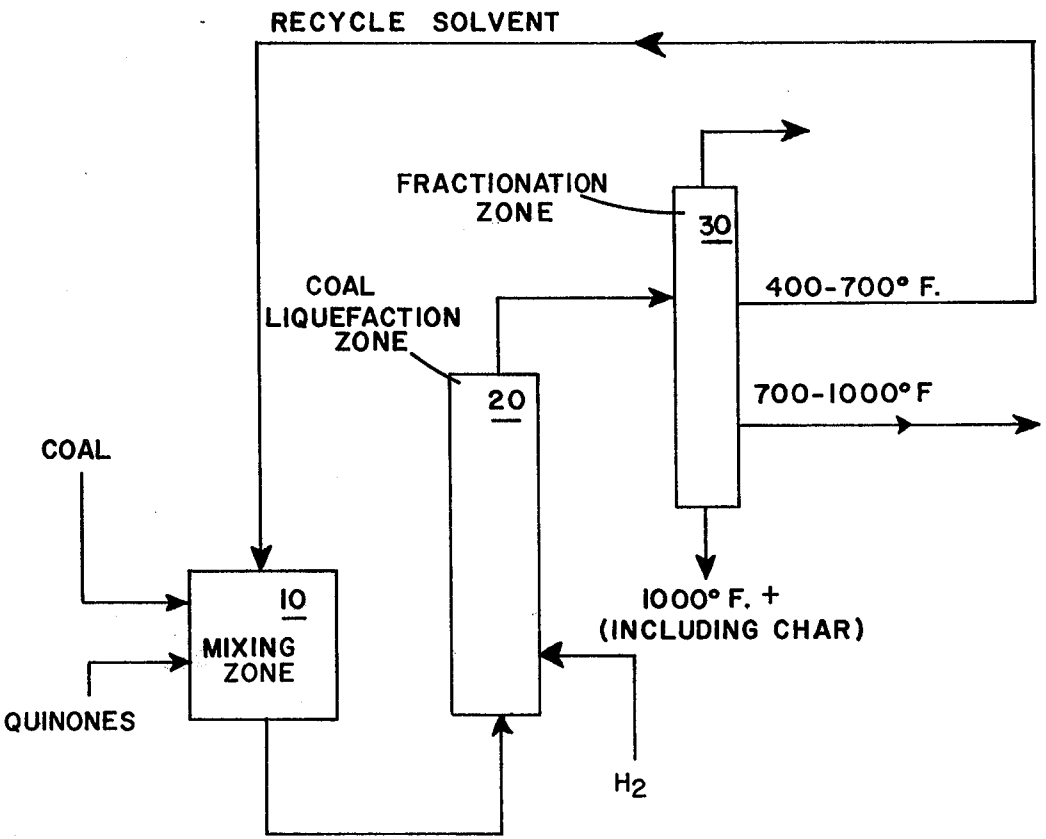

COAL LIQUEFACTION PROCESS

Processes for the conversion of coal into useful petroleum-like liquid products have been known for many years. Of particular interest are those which utilize a hydrogen transfer, or hydrogen donor solvent to hydrogenate and liquefy the coal. In such processes, crushed coal is contacted at elevated temperature and pressure with a solvent, often a liquid fraction derived from within the process, which acts as a hydrogen donor. The solvent supplies hydrogen to the hydrogen-deficient coal molecules, as molecules are thermally cracked and cleaved from the disintegrating coal solids.

In the breaking coal molecules, since coal largely comprises polymerized multi-ring aromatic structures, each bond rupture results in the formation of extremely reactive free radicals, which moieties can be stabilized by the addition of a hydrogen atom. If the hydrogen stabilized moieties are sufficiently small they are evolved as a portion of the liquid product. If the moieties are excessively large, or if the hydrogen cannot be effectively used to heal the reactive free radicals, the fragments will polymerize, and when this occurs char and coke are produced.

The addition of carbon radical scavengers to a coal liquefaction process to heal the reactive sites of the free radicals is known, and a process of this type is disclosed, e.g., in U.S. Pat. No. 3,700,583 issued to Salamony et al on Oct. 24, 1972. The Salamony et al process describes the use of quinones, particularly quninone derivatives of mono- and/or polynuclear aromatic compounds, certain halogens and halogen halides thereof as carbon-radical scavengers which are added with a hydrogen donor solvent to the coal liquefaction zone to increase the amount of liquid product, as measured by an increase in the amount of benzene-soluble liquids in the total product. A preferred technique for adding quinones to the solvent, in accordance with the disclosed process, is to treat a 700°-1000° F. fraction of the liquid product in an oxidation zone to form the quinone carbon radical scavengers in situ. The vaporized 700°-1000° F. fraction is thus contacted with air in the presence of an oxidation catalyst at temperatures ranging from about 800°-1000° F., at atmospheric pressure.

In the Salamony et al process, an indiginous 400°-700° F. solvent fraction is regenerated for recycle to the coal liquefaction zone by hydrogenation in a separate hydrogenation reactor, the solvent being contacted with hydrogen in the presence of a heterogeneous Group VIB or Group VIII metal hydrogenation catalyst. Both the regenerated solvent and quinone containing fractions are recycled, and molecular hydrogen is also added to the coal liquefaction zone to provide improved yields of benzene-soluble hydrocarbons on the order of about 7 to 10 weight percent (MAF coal).

It has proven feasible to bring about greater dissolution of coal at given elevated temperatures by using solvents which are capable of giving up hydrogen to the solute. The use of donor solvents provides higher yields of quality products, and more satisfactory reactor throughput per unit of reactor space, than processes otherwise similar which do not employ donor solvents. In processes which utilize such vehicle the rate of hydrogen absorption and consequently the rate of conversion, is greatly increased. Molecular hydrogen per se is less effective in converting the coal, even in the presence of a non-donor solvent. A process utilizing both a solvent donor and molecular hydrogen as contrasted with one using only the solvent donor is only slightly more effective in improving overall liquefaction yields than the latter. The most notable effect of the added molecular hydrogen is to rejuvenate the spent solvent in the solvent hydrogenation reactor. Means which would permit a more direct effective hydrogenation of the coal, or coal liquids, with molecular hydrogen would constitute a meritorious advancement in the state of the coal liquefaction art.

It is, accordingly, the primary objective of the present invention to supply this need.

A particular object is to provide a new and improved process utilizing a homogeneous hydrogenation catalyst which can be added to the coal liquefaction zone to provide for the more effective hydrogenation of coal with molecular hydrogen, even in the presence of a non-donor solvent.

A more particular object is to provide a new and improved process combination for the liquefaction of coal, particularly one which will obviate the need for an external solvent hydrogenation unit.

These and other objects are achieved in accordance with the present invention characterized generally as a process for liquefying a particulate coal feed to produce useful petroleum-like liquid products by steps which include: (a) admixing said coal feed, a solvent, inclusive particularly of a non-donor solvent, and a quinone compound, or admixture of quinone compounds, to form a coal liquid slurry, and then (b) contacting said coal liquid slurry with molecular hydrogen in a liquefaction zone at temperature and pressure sufficient to hydroconvert and liquefy the coal. A feature of the invention is that the quinone compound acts as a hydrogenation catalyst, the presence of which permits efficient and adequate hydrogenation of the coal by the molecular hydrogen, even in the presence of a solvent which possesses very little or only a mild potential to impart hydrogen to the reactants at reaction conditions, or even in the presence of a non-donor solvent.

In accordance with a preferred embodiment, the process is one comprised of the combination of steps which include: (a) admixing said coal feed, a non-donor solvent, and a quinone compound, or admixture of quinone compounds, to form a liquid coal slurry, (b) contacting said coal liquid slurry with molecular hydrogen to hydrogenate the coal and form a liquid product mixture, (c) separating the liquid product mixture into fractions, inclusive of a liquid solvent fraction, and (d) recycling said liquid solvent fraction to the coal slurry formation stage [i.e. stage (a)] without hydrogenation of the solvent (whether or not it contains hydrogen donor precursors, or hydroaromatic compounds which on hydrogenation form hydrogen donor compounds) prior to recycle, for use as non-donor solvent.

In yet another preferred embodiment, the product from the coal liquefaction zone is separated by distillation into fractions inclusive of fractions boiling within about the 350°-850° F. range, and preferably within about the 400°-700° F. range, which can be recycled to the coal liquefaction zone for use in slurrying the coal. A feature of this invention is that the quinone compound acts as a hydrogenation catalyst, the presence of which catalyst within the coal liquefaction zone, permits adequate hydrogenation of the coal by the molecular hydrogen, without any necessity of employing a hydrogen donor solvent, and hence there is no need for hydrogenation of the solvent in a separate hydrogenation zone.

A quinone compound, or mixture of quinones and/or other compounds, is dispersed or dissolved within the carrier liquid, or solvent within which the coal is slurred, and the slurry then contacted with molecular hydrogen, and the coal hydrogenated, the quinone effectively catalyzing the hydrogenation reaction. The quinone is a cyclic compound characterized by the presence of the quinoid structure or system wherein two keto or hydroxy groups are connected by a system of conjugated double bonds. It is a mono- or polycyclic hydrocarbon compound which contains two oxygen atoms, or hydroxyl groups which occupy either ortho or para positions one oxygen atom or hydroxyl group relative to the other. Where the quinone is polycyclic, the rings constituting the nucleus of the molecule can be fused or non-fused, or can contain both fused and non-fused rings. The quinone generally contains from 1 to about 6 rings in the total molecule, and preferably from 1 to about 3 rings, with 1 or 2 rings being most preferred. The rings can be substituted or unsubstituted, and in terms of carbon atoms the total molecule can contain from 6 to about 36 carbon atoms, preferably from 6 to about 14 carbon atoms. Sterically unhindered molecules are preferable and, therefore, where substituents are present large branched substituent chains, and highly polar groups are generally to be avoided. The oxygen atoms of the keto groups (or hydroxy groups) while occupying positions ortho or para one to the other can be on the same ring, or can be located on different rings. Polynuclear polyquinones, particularly diquinones are also satisfactory. Exemplary of quinone compounds suitable for the practice of this invention are such species as o-benzoquinone, p-benzoquinone, 2,5-dichloro-p-benzoquinone, tetrachloro-p-benzoquinone, 1,2-naphthoquinone, 1,4-naphthoquinone, 2-methyl-1,4-naphthoquinone, 2,6-naphthoquinone, 1,2-anthraquinone, 1,4-anthraquinone, 1,7-anthraquinone, 9,10-anthraquinone, phenanthrene quinone, acenaphthene quinone, chrysene quinone, 4,4'-diphenoquinone, 2,2'-dephenoquinone, 4,4'-stilbenequinone, 1,2,3,4-naphthodiquinone, 1,4,5,8-naphthodiquinone and the like. The ortho quinones are a preferred species, as contrasted with the para quinones.

In the preferred practice of this invention, the quinone compound, or admixture of quinone compounds, is added to a liquid fraction separated from the liquid products obtained from within the process, suitably a fraction boiling within the range of from about 350° F. to about 850° F., and preferably from about 400° to about 700° F. Whereas these fractions have been found admirably suitable as solvent donors, because of the presence of solvent donor compounds in adequate concentration to supply the necessary hydrogen under coal liquefaction conditions, and because they can be regenerated in an external hydrogenation reactor, the presence of a donor solvent is unnecessary in the present invention.

Solvents useful for the practice of this invention, defined in terms of hydrogen donor potential, are (1) non-donor solvents, or solvents which contain less than 0.8 percent donatable hydrogen, based on the weight of solvent, and (2) donor solvents, or solvents which contain at least 0.8 percent, and generally from about 1.2 to about 3 percent, and greater, of donatable hydrogen, based on the weight of solvent. Donor solvents thus generally contain about 30 percent, and most often about 50 percent, or greater, of an admixture of hydrogen donor compounds, adequate to supply the necessary hydrogen at reaction conditions, based on the total weight of solvent. In accordance with the present invention, however, the latter type of solvent if used initially in carrying out a coal liquefaction reaction need not be regenerated by hydrogenation prior to recycle, for use of a hydrogen donor solvent is unnecessary to the practice of the present invention. The quinone catalysts permit adequate hydrogenation via use of molecular hydrogen in the coal liquefaction reaction.

The quinone compound is added to the coal feed in concentration ranging from about 0.1 to about 5 percent, and preferbly from about 0.1 to about 2 percent, based on the weight of coal feed.

The reason for the effectiveness of a quinone compound in catalyzing the hydrogenation reaction, while not completely understood, is predicted on a sound theoretical basis. It was heretofore known that quinones are oxidizing agents, that a quinone, Q, could be catalytically hydrogenated and converted to a hydroquinone, $OH_2$, and from electrochemical studies it was even known that the hydrogenation of a quinone, to use p-benzoquinone as illustrative, could proceed in a reversible stepwise two electron reduction fashion, (from quinone, Q, to semiquinone, OH., to hydroquinone ($QH_2$)), to wit:

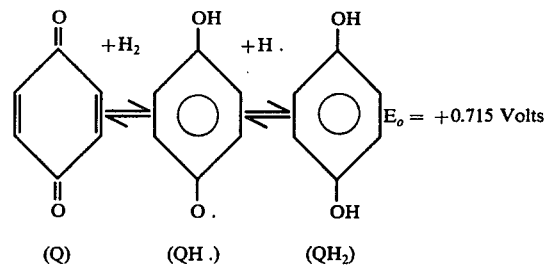

Quinones, as known from various organic reactions, are capable of abstracting hydrogen from saturates (R) and hydroaromatics (A), pursuant to the following reactions $$R + Q \rightleftarrows R^{--} + QH_2$$

$$H_2A + Q \rightleftarrows A + QH_2$$

to form unsaturates ($R^{--}$) and aromatics (A). In accordance with the theory of Salamony et al, quinone, in its action as a carbon-radical scavenger would be consumed, and such reaction would be expected to procede as follows: Coal would break down into free radical moieties to wit:

$$\text{Coal} \xrightarrow{\Delta} R.$$

The quinone, Q, would then react with the free radical, R., as follows:

$$R. + Q \rightarrow RH + Q. \quad (1)$$

or polymerize with free radicals to give $$R. + Q \rightarrow QOR + Q(OR)_2 \quad (2)$$

or $$R. + Q \rightarrow RQ.$$

where Q. and RQ. are polymer precursors and QOR and $Q(OR)_2$ are polymers. Applicants' have established, however, that quinones can act as a true catalyst at hydrogenation conditions, a reversible equilibrium between the quinone structure and the hydroquinone structure being established such that the quinone is readily hydrogenated by molecular hydrogen, and the hydrogen is readily conveyed from the hydroquinone to a hydrogen deficient site on a reactant molecule, to wit:

$$Q \xrightarrow{+H_2} QH. \xrightarrow{+H.} QH_2$$

$$R. + QH_2 \rightarrow QH. + RH$$

$$QH. + R. \rightarrow Q + RH$$

At these severe conditions quinones can also serve to catalyze the hydrogenation of aromatic molecules, to wit:

$$A + H_2 \xrightarrow{Q} AH_2$$

In accordance with the best mode of practicing the present invention, generally illustrated in schematic fashion by reference to the attached FIGURE (a) quinone, or admixture thereof, is added to the solvent within which particulate coal is to be slurried in a vessel, or mixing zone 10 at ambient conditions. The solvent can be fresh or recycle, as desired. (b) The coal slurry is then fed with hydrogen, upflow or downflow, generally upflow, into a reactor, or coal liquefaction zone 20 at elevated temperature. (c) Effluent from the top of reactor 20 is passed into a separation or fractionation column 30 and split, suitably into a multiplicity of fractions, one of which can be recycled if desired as a solvent.

These conditions are more specifically described, as follows:

a. In the mixing zone 10, the quinone compound is added to the solvent in concentrations ranging from about 0.01 to about 5 weight percent, preferably from about 0.1 to about 2 weight percent. Suitably, the solvent is added in a ratio of solvent: coal ranging from about 0.8:1 to about 2:1, based on weight. The solvent to which the quinone compound is added is generally one which boils below 1000° F., but preferably within the range of about 350° to about 850° F., more preferably from about 400° to about 700° F. The slurry in admixture with the quinone compound is fed, with molecular hydrogen, into the coal liquefaction zone 20.

b. Within coal liquefaction zone 20, temperatures range generally from about 700° to about 950° F., preferably from about 800° to about 900° F., with pressures ranging from about 300 psig to about 3000 psig, preferably from about 800 psig to about 2000 psig. Molecular hydrogen is added to the reaction zone 20 at a rate of from about 500 to about 10,000 SCF/Bbl, preferably from about 1000 to about 6000 SCF/Bbl, at rates ranging from about 0.1 to about 10 SLHV, preferably from about 0.2 to about 2 SLHV. Residence times range from about 5 to about 130 minutes, preferably from about 10 to about 60 minutes.

c. The effluent from reaction zone 20 consisting of a reaction product mixture of gases and liquids, the liquids comprising a mixture of solvent, a quinone compound, or compounds, and heavier ends, is transferred into a separation zone or fractionation column 30 wherein, e.g., light boiling fractions, intermediate boiling fractions and heavy boiling fractions can be recovered as desired. Any suitable solvent fraction, e.g., fractions boiling from about 400° to 700° F. can be recovered, and all or a portion thereof recycled, as desired.

These and other features of the present process will be better understood by reference to the following comparative data set forth in the subsequent demonstration and examples obtained by liquefying the coal slurries in accordance with this invention. All units are in terms of weight unless otherwise specified.

EXAMPLES 1-2

A series of runs were conducted to quantify and compare the catalytic activity of various quinone hydrogenation catalysts toward the production of liquid products from coal by hydrogenation of thermally generated coal radicals. In conducting this series of runs, 3.0 grams of −200 mesh (Tyler) dry Illinois No. 6 Coal, 6.0 grams of non-donor solvent, and 5 weight percent quinone catalyst were charged as feed to stainless steel tubing bombs of 30 cc internal volume. A comparative run was also made, except that no quinone was charged to the bomb. Each of the tubing bombs were charged with 500 psig molecular hydrogen gas at room temperature. The bombs were then sealed and submerged horizontally in a constant temperature sandbath to provide the desired reaction temperature. During the runs, the bombs were agitated at 120 cycles per minute for 130 minutes in the fluidized sandbath heated sufficiently to provide a temperature of 840° F. The total pressure was about 1500 psig at 840° F. The bombs, at the end of the time period, were opened and the various phases separated to give the results shown in Table 1. The solid products are those materials which are insoluble in cyclohexane at room temperature.

Table 1

| Catalyst | Gas | Liquid | Solid | Donatable Hydrogen Content of Products |
|---|---|---|---|---|
| None | 20.8 | 31.5 | 48.3 | 0.27 |
| o-hydroquinone | 18.5 | 38.5 | 43.0 | 0.41 |
| p-hydroquinone | 16.7 | 35.0 | 48.1 | 0.29 |

It is apparent that various modifications can be made in the process without departing from the spirit and scope of the present invention.

Having described the invention what is claimed is:

1. A process for liquefying a particulate coal feed to produce useful petroleum-like liquid products, which comprises: (a) admixing said coal feed, a non-donor solvent, and a quinone compound, or admixture of quinone compounds, to form a coal liquid slurry, (b) contacting said coal liquid slurry with molecular hydrogen in a liquefaction zone at temperature and pressure sufficient to hydroconvert and liquefy the coal to form a liquid product mixture, (c) separating the liquid product mixture into fractions, inclusive of a liquid non-donor solvent fraction, and (d) recycling said liquid non-donor solvent fraction for slurrying with the coal, without hydrogenation of the non-donor solvent prior to recycle.

2. The process of claim 1 wherein the temperature of coal liquefaction ranges from about 700° to about 950° F.

3. The process of claim 2 wherein the temperature ranges from about 800° to about 900° F.

4. The process of claim 1 wherein the pressure of the coal liquefaction zone ranges from about 300 psig to about 3000 psig.

5. The process of claim 4 where the pressure ranges from about 800 psig to about 2000 psig.

6. The process of claim 1 wherein said solvent is one boiling within a range of from about 350° to about 850° F.

7. The process of claim 6 wherein said solvent is one which boils within a range from about 400° to about 700° F.

8. A process for liquefying a particulate coal feed to produce useful petroleum-like liquid products, which comprises: (a) admixing said coal feed, a non-donor solvent, and a quinone compound, or admixture of quinone compounds, to form a coal liquid slurry, and then (b) contacting said coal liquid slurry with molecular hydrogen in a liquefaction zone at temperature and pressure sufficient to hydroconvert and liquefy the coal.

9. The process of claim 8 wherein the temperature of coal liquefaction ranges from about 700° to about 950° F.

10. The process of claim 9 wherein the temperature ranges from about 800° to about 900° F.

11. The process of claim 8 wherein the pressure of the coal liquefaction zone ranges from about 300 psig to about 3000 psig.

12. The process of claim 11 wherein the pressure ranges from about 800 psig to about 2000 psig.

13. The process of claim 8 wherein said solvent is one boiling within a range of from about 350° to about 850° F.

14. The process of claim 13 wherein said solvent is one which boils within a range from about 400° to about 700° F.

* * * * *